US007458841B2

(12) United States Patent
Kobayashi

(10) Patent No.: US 7,458,841 B2
(45) Date of Patent: Dec. 2, 2008

(54) WIRE COVER AND A LOCKING CONSTRUCTION THEREFOR

(75) Inventor: Tomohiko Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/900,565

(22) Filed: Sep. 12, 2007

(65) Prior Publication Data

US 2008/0064261 A1 Mar. 13, 2008

(30) Foreign Application Priority Data

Sep. 13, 2006 (JP) ..... 2006-248456
Sep. 13, 2006 (JP) ..... 2006-248457

(51) Int. Cl.
*H01R 13/56* (2006.01)

(52) U.S. Cl. ..... 439/466; 174/72 A

(58) Field of Classification Search ..... 439/466, 439/468, 467, 473
See application file for complete search history.

(56) References Cited

U.S. PATENT DOCUMENTS 5,315,062 A 5/1994 Hoshino
6,364,693 B1 * 4/2002 Stagg et al. ..... 439/467
6,962,504 B2 * 11/2005 Fukui et al. ..... 439/466
2004/0102082 A1 5/2004 Tsuji et al.
2006/0172612 A1 8/2006 Wasalaski et al.
2007/0228768 A1 * 10/2007 Kobayashi ..... 296/146.1
2008/0083557 A1 * 4/2008 Kobayashi et al. ..... 174/168
2008/0121426 A1 * 5/2008 Kobayashi et al. ..... 174/72 A

FOREIGN PATENT DOCUMENTS

JP 2004-348988 12/2004

* cited by examiner

*Primary Examiner*—Neil Abrams
*Assistant Examiner*—Phuong Nguyen
(74) *Attorney, Agent, or Firm*—Gerald E. Hespos; Anthony J. Casella

(57) ABSTRACT

A wire cover (1) has a connector-side fixing portion (10) to be fixed to a connector, a wire pressing portion (20) to be held in contact with wires (W), and a connecting portion (30) connecting the connector-side fixing portion (10) and wire pressing portion (20). Resilient engaging pieces (23) project from the wire pressing portion (20) and are formed with engaging holes (25) that can engage engaging projections (42) of a mating member (40) to fix the wire pressing portion (20) to the mating member (40). Catching holes (26) are formed at the leading ends of the resilient engaging pieces (23) and can be caught by a jig (50) inserted from the base side of the resilient engaging piece (23) to displace the resilient engaging piece (23) in a direction to disengage the engaging hole (25) and engaging projection (42).

14 Claims, 9 Drawing Sheets

WIRE COVER AND A LOCKING CONSTRUCTION THEREFOR

BACKGROUND OF THE INVENTION

1. Field of the Invention

The invention relates to a wire cover, for example, to be mounted on wires connected with a connector, and to a locking construction therefor.

2. Description of the Related Art

Japanese Unexamined Patent Publication No. 2004-348988 discloses a wire cover with a wire pressing portion to be brought into contact with bent parts of wires drawn out from a connector. The wire pressing portion is fixed to a connector housing by a resilient engaging piece.

Connectors often are arranged in a small space and close to other parts. In such cases, the connector housing must be miniaturized and there may not be sufficient room to provide a locking structure for the wire cover. Thus, the wire cover is fixed to a mating member, to which the connector is attached, instead of being attached to the connector.

This problem may arise with a connector to be attached to a switch for detecting the operation of a door handle in a vehicle door. In this situation, a wire cover is fixed to a mating member in the door, to which the connector is attached, instead of being fixed to the connector. Even in this situation, an entrance path must be provided for inserting the leading end of a resilient engaging piece of the wire cover towards the mating member. However, space limitations inside the door may not permit extra space around the resilient engaging piece for proper engagement with the mating member. The connector or wire cover may have to be detached for repair, inspection or other purpose. Accordingly, a jig, such as a minus driver, must be inserted straight from the base end of the resilient engaging piece towards the back side for disengaging the resilient engaging piece. However, it is very difficult to disengage the resilient engaging piece in this manner and operability is very poor.

The invention was developed in view of the above problems, and an object thereof is to enable a wire pressing portion to be detached easily from a mating member by at least partly inserting a disengagement jig from the base end of a resilient engaging piece of the wire pressing portion.

SUMMARY OF THE INVENTION

The invention relates to a wire cover for bending at least one wire or cable drawn out from a connector in a direction different from a draw-out direction. The wire cover comprises a connector-side fixing portion to be fixed to the connector, a wire pressing portion to be held in contact with the wire, and a connecting portion connecting the connector-side fixing portion and wire pressing portion. At least one resilient engaging piece projects from the wire pressing portion and is formed with at least one engaging portion. The resilient engaging piece can be fixed to a mating member fit to the connector by engaging the at least one engaging portion with at least one engageable portion of the mating member. At least one catch is provided and can engage a jig to make the resilient engaging piece displaceable in a direction to disengage the engaging portion and the engageable portion.

The jig preferably is inserted from the base end of the resilient engaging piece to engage the catch. The jig enables the resilient engaging piece to be displaced in a direction to disengage the engaging portion from the engageable portion and to detach the resilient engaging piece from the mating member.

The mating member preferably includes two opposed engaging walls each having the engageable portion. Two resilient engaging pieces are provided for fitting to the corresponding engaging walls from outer sides.

Each resilient engaging piece preferably is formed integrally or unitarily with an auxiliary wall that is insertable at an inner side of the corresponding engaging wall to sandwich the engaging wall between the resilient engaging piece and the auxiliary wall. Thus, the engaging portions and engageable portions are held engaged. Forces could urge the resilient engaging pieces outward. However, the engaging portions and engageable portions are not easily disengaged, since the resilient engaging pieces become more difficult to deform than if the resilient engaging pieces are provided separately from the auxiliary walls.

The engaging portions of the resilient engaging pieces preferably are engaging holes and the engageable portions of the engaging walls preferably are engaging projections. Engaging forces of the engaging projections and engaging holes are determined by the depth of the engaging holes, i.e. the thickness of the engaging walls. Here, to further enhance the engaging forces, it is necessary to thin the resilient engaging pieces and thicken the engaging wall portions by as much as the resilient engaging pieces are thinned. However, resilient forces are reduced if the resilient engaging pieces are thinned, thereby losing the significance of integrally providing the resilient engaging pieces with the auxiliary walls. However, as described above, the depth of the engaging holes can be increased by thickening the resilient engaging pieces at sides opposite to the engaging walls. Therefore, the engaging forces can be enhanced without reducing the resilient forces of the resilient engaging pieces.

The invention also relates to a locking construction for a wire cover. The locking construction comprises at least one engaging projection projecting from a mating member to which the connector is to be attached. At least one resilient engaging piece projects from the wire pressing portion substantially towards the engaging projection. At least one engaging portion is provided on the resilient engaging piece and can fix the resilient engaging piece to the mating member by engaging the engaging projection. At least one disengagement recess is formed in the engaging projection for receiving the leading end of a disengagement jig and causing the jig to displace the engaging portion for the disengagement from the engaging projection.

Accordingly, the disengagement jig preferably can be inserted from the base end of the resilient engaging piece to insert the leading end of the jig through the disengagement recess and into a clearance between the engaging portion and mating member. Thus, the engaging portion can be displaced away from the mating member and disengaged. Therefore, the resilient engaging piece can be detached from the mating member by inserting the disengagement jig from the base end of the resilient engaging piece.

Two resilient engaging pieces preferably project to hold the engaging projection therebetween.

Each engaging portion preferably is substantially U-shaped with leading ends of the resilient engaging pieces being joined integrally or unitarily. Accordingly, the disengagement recesses can be at positions that can be seen from the base ends of the resilient engaging pieces when the resilient engaging pieces are attached to the mating member. Further, the disengagement jig can be inserted in a posture substantially parallel to a projecting direction of the resilient engaging pieces. Therefore, a disengaging operation can be performed more easily than in the case where through holes are formed at the leading ends of the resilient engaging pieces and leading ends of surrounding walls forming the through holes serve as engaging portions.

The mating member preferably includes two engaging walls each having the engaging projection and substantially facing each other. Two resilient engaging pieces are provided to fit to the corresponding engaging walls from outer sides.

Each resilient engaging piece preferably is formed integrally or unitarily with at least one auxiliary wall insertable at an inner side of the corresponding engaging wall to sandwich the engaging wall between the resilient engaging piece and the auxiliary wall. Accordingly, the engaging walls can be sandwiched between the resilient engaging pieces and auxiliary walls. Thus, the engaging portions and engaging projections can be held engaged. Even if the resilient engaging pieces should try to be resiliently deformed outward, there is no likelihood that the engaging portions and engaging projections are disengaged easily since the resilient engaging pieces become more difficult to deform than in the case where the resilient engaging pieces are provided separately from the auxiliary walls.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 4:
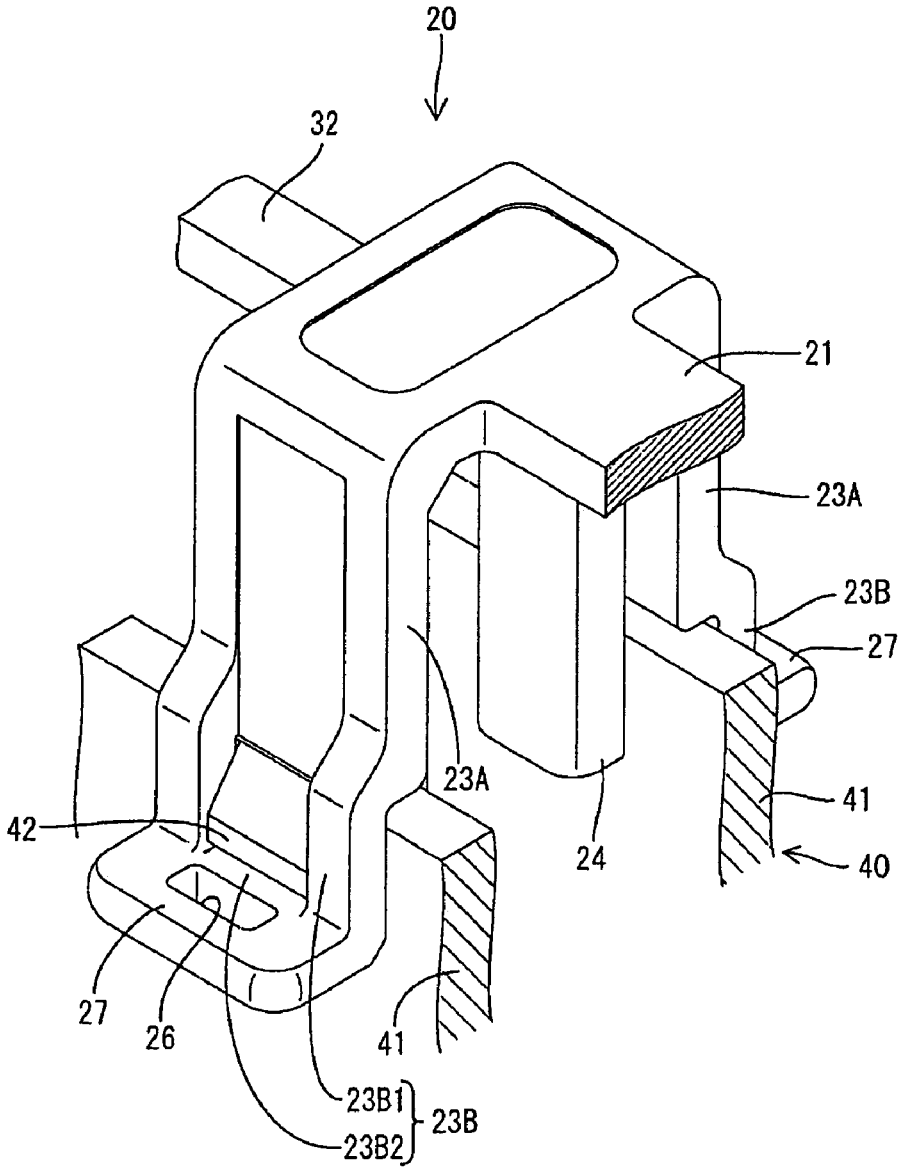
FIG. 4 is a perspective view showing a state where the wire pressing portion is attached to a mating member.
Figure 5:
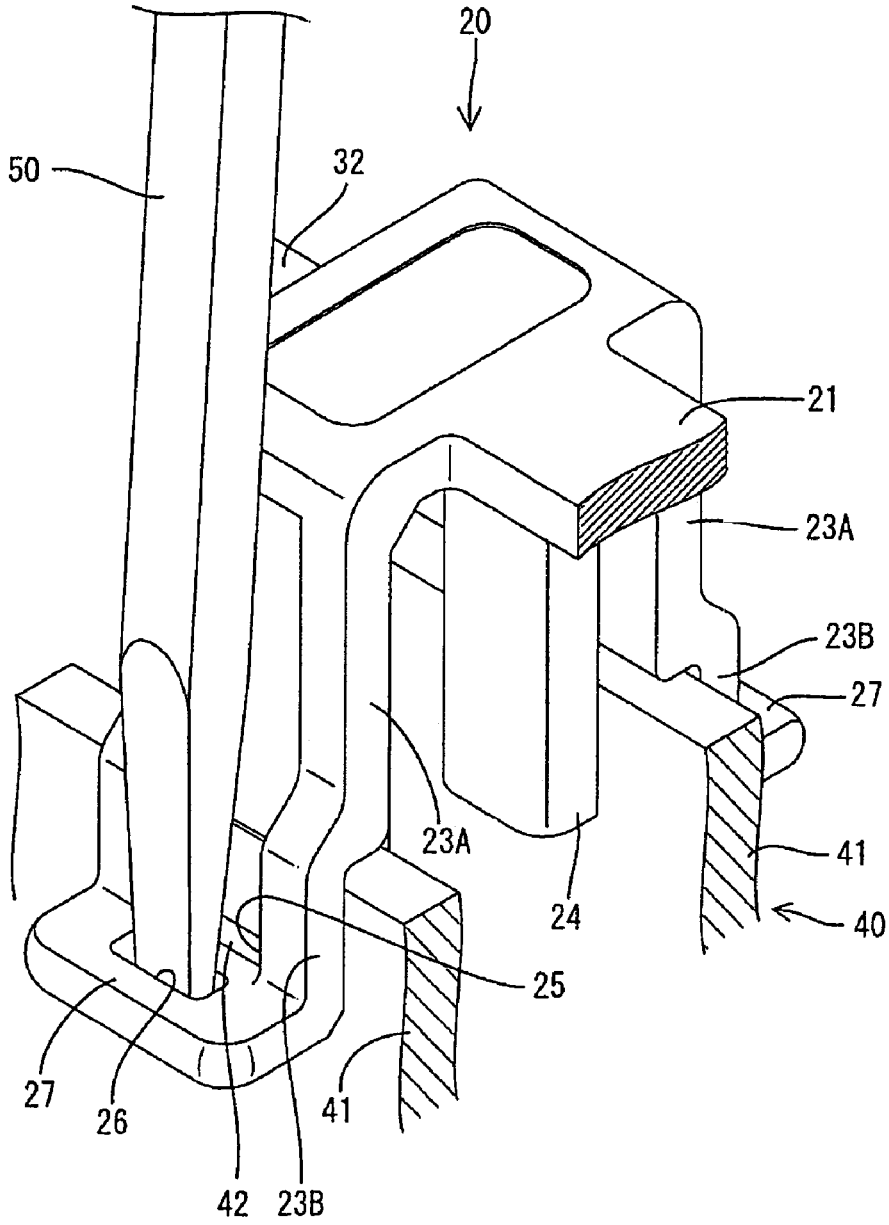
FIG. 5 is a perspective view showing a state where a disengagement jig is inserted into a catching hole.

A wire cover in accordance with the invention is identified generally by the numeral 1 in FIGS. 1, 2, 7 and 8. The wire cover 1 functions to bend wires W drawn out through a wire draw-out end of a connector (not shown) attached to a mating member identified by the numeral 40 in FIGS. 4-6 so that the wires W extend in a direction different from a draw-out direction. Thus, the wire cover 1 guides the wires W through the bend and in a specified direction.

Figure 1:
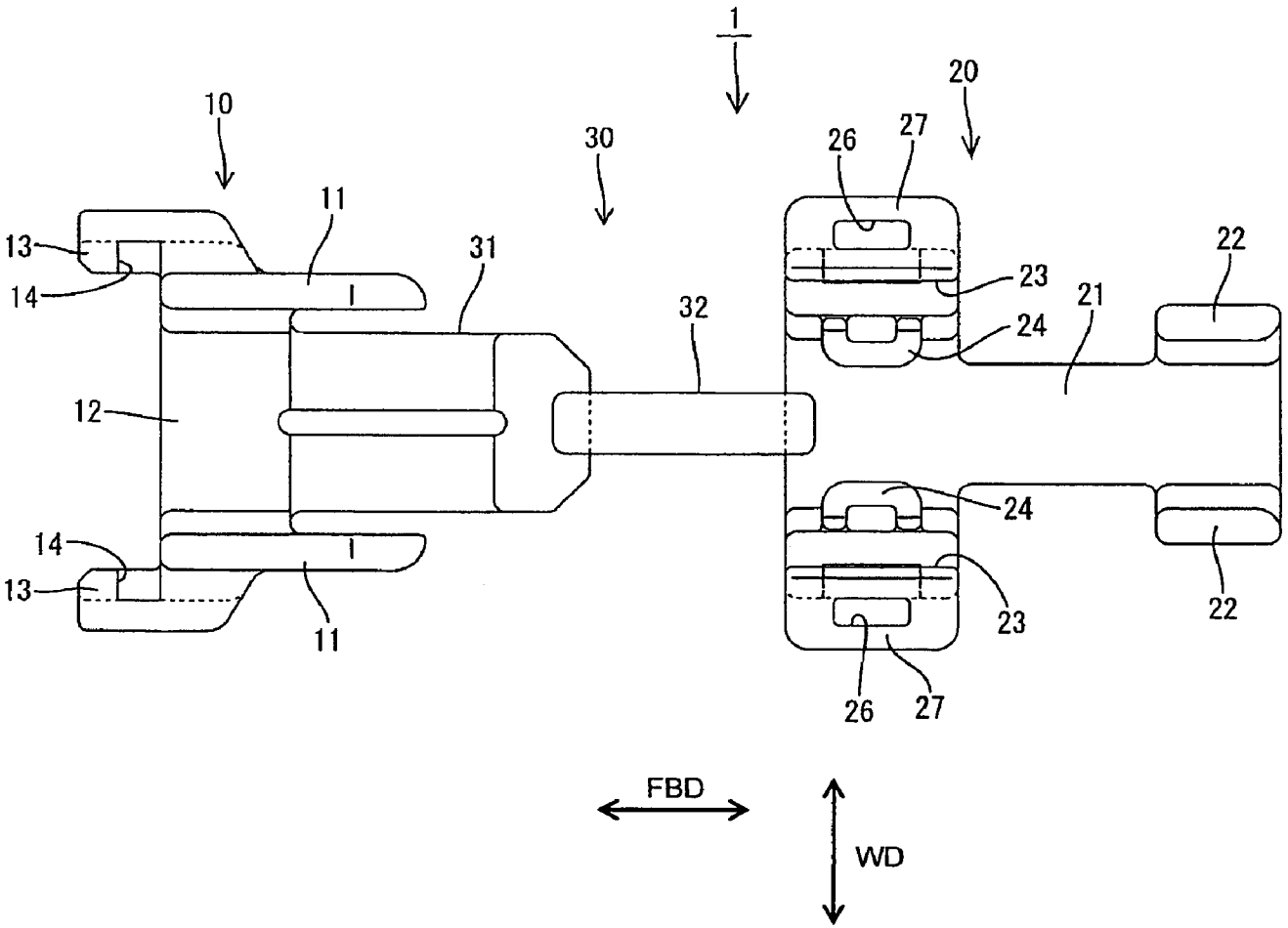
FIG. 1 is a bottom view of a wire cover according to one embodiment.
Figure 6:
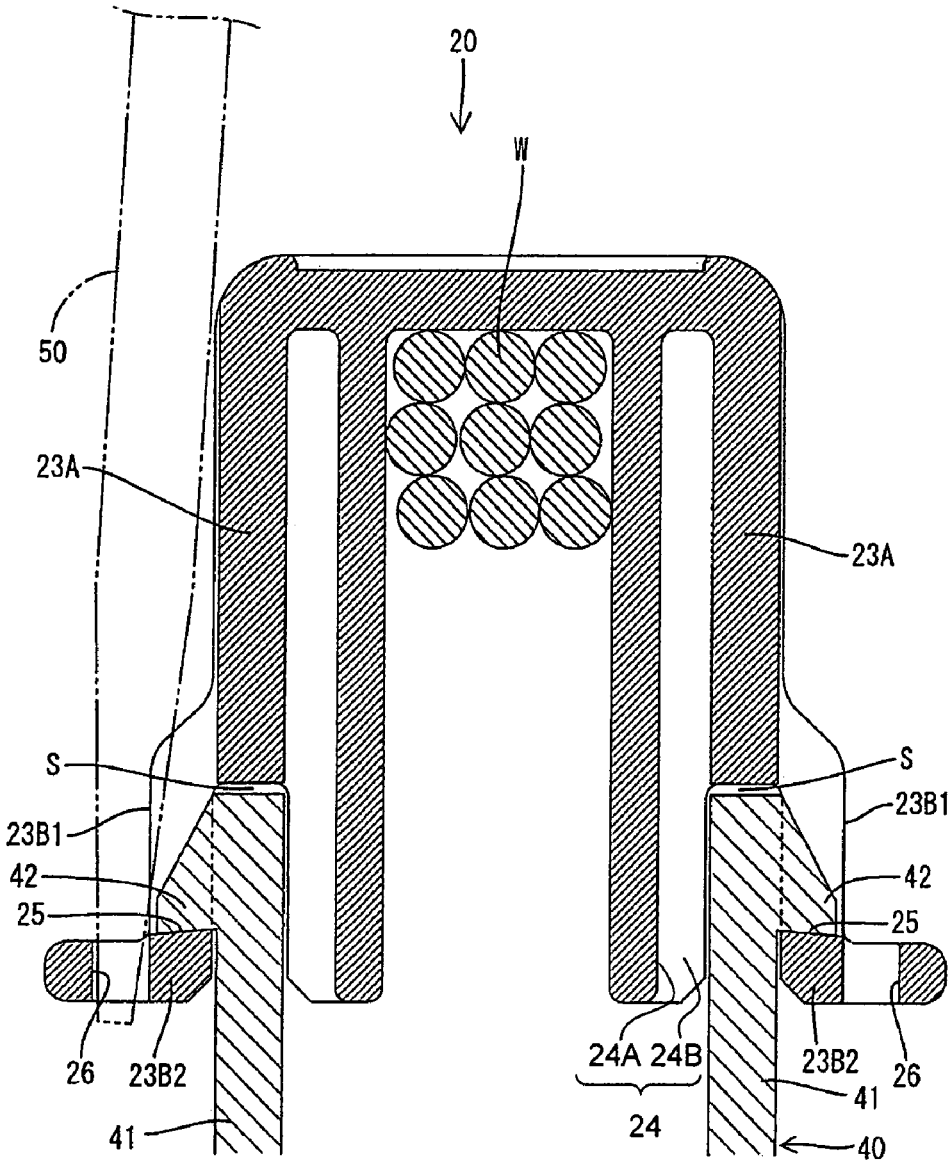
FIG. 6 is a section taken along line 6-6 in FIG. 2 showing the state where the disengagement jig is inserted into the catching hole.

As shown in FIG. 1, the wire cover 1 has a connector-side fixing portion 10 to be fixed to the connector, a wire pressing portion 20 to be fixed to the mating member 40 and a connecting portion 30 unitarily connecting the connector-side fixing portion 10 and wire pressing portion 20. On the other hand, the mating member 40 has two opposed engaging walls 41 and an engaging projection 42 projects from surfaces of end portions of the engaging walls 41 opposite to the facing surfaces, as shown in FIG. 6. In the following description, a direction normal to the plane of FIG. 1 is referred to herein as the vertical direction VD, with the back side being the upper end. The transverse direction in FIG. 1 corresponds to the forward and backward directions FBD, with the right side in FIG. 1 being the front end. The vertical direction in FIG. 1 is referred to herein as the width direction WD.

The connector-side fixing portion 10 includes two side plates 11 that face each other in the width direction WD, and upper ends of the side plates 11 are connected by an upper wall 12. Fixing plates 13 are formed unitarily on the outer side surfaces of the respective side plates 11, and project back along the forward and backward directions FBD. Fixing grooves 14 are formed in the fixing plates 13 and extend up from the bottom end. The fixing grooves 14 can engage lock projections (not shown) on the rear end of side walls of the connector to fix the connector-side fixing portion 10 to the connector. Thus, the rear end of the connector will be fit between portions of the fixing plates 13 that project beyond the upper wall 12. Additionally, the rear surface of the connector will extend in the vertical direction VD of FIG. 2. The wires initially will extend in the forward and backward directions FBD, but will be bent down in FIG. 2 substantially into the vertical direction VD at positions rearward of the connector and the fixing plates 13 and between the side plates 11.

Figure 2:
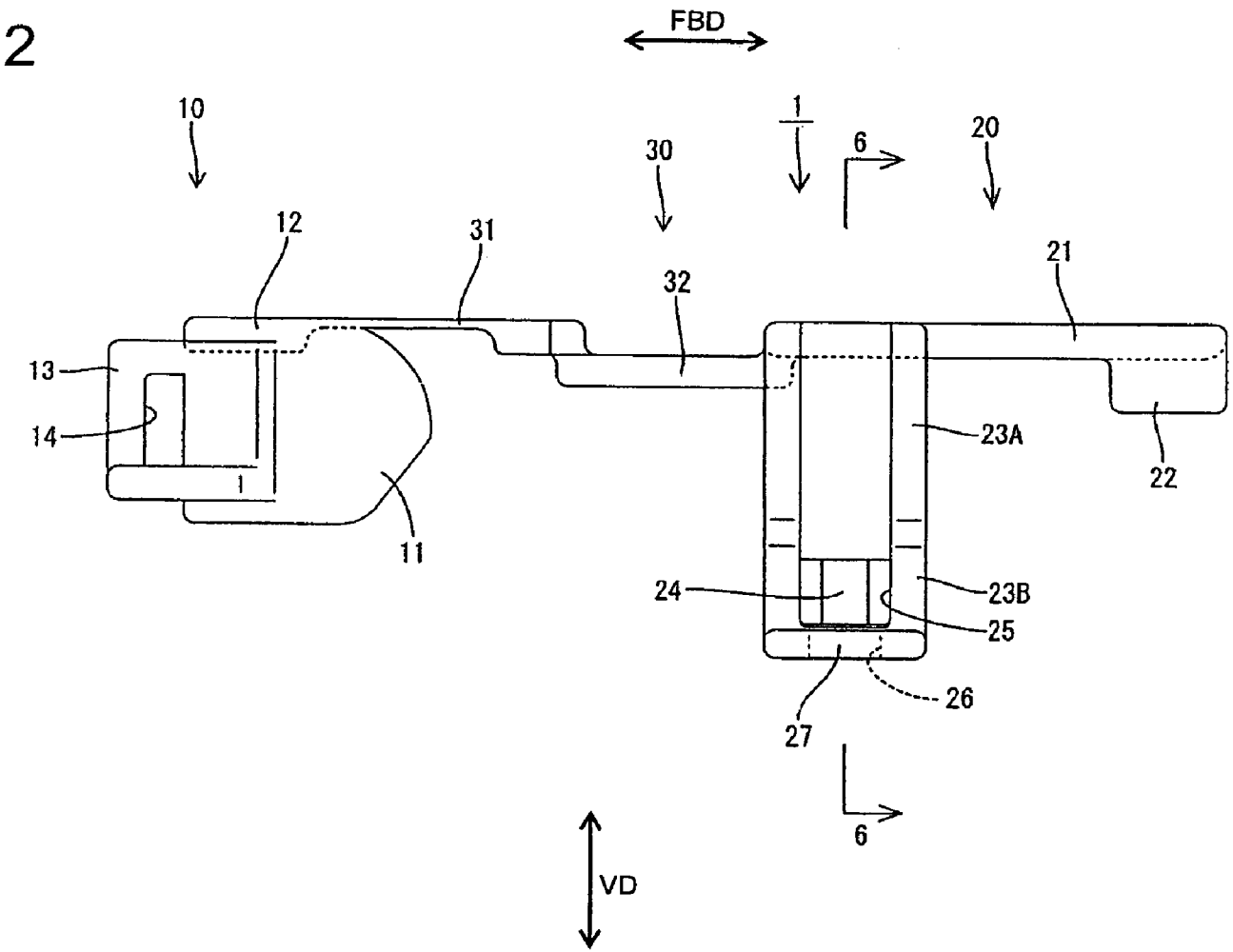
FIG. 2 is a side view of the wire cover.
Figure 3:
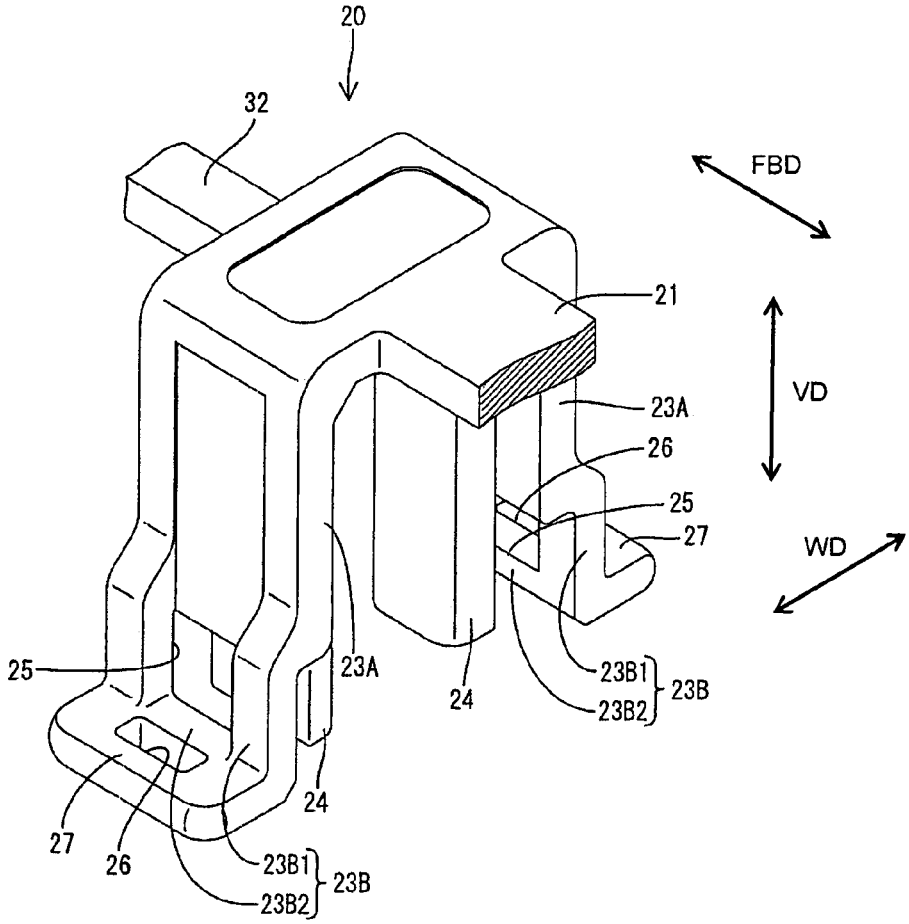
FIG. 3 is a perspective view showing only a wire pressing portion.

As shown in FIG. 2, the connecting portion 30 includes a flexible resilient portion 31 that extends forward from the front end edge of the upper end wall 12, and a wire constraining portion 32 is coupled to the front end edge of the resilient portion 31. The width of the resilient portion 31 is slightly less than a distance between the side plates 11 of the connector-side fixing portion 10. Thus, the resilient portion 31 can be bent into a position be between the side plates 11 and a bend accommodating portion is formed by the inner surfaces of the side plates 11 and the inner surface of the resilient portion 31.

The wire constraining portion 32 is substantially rod- or column-shaped and is formed so as not to be resiliently deformable or to have a significantly reduced resiliency as compared to the resilient portion 31. The wire constraining portion 32 is to be fixed to the wires W by a binding band, clamp or the like (not shown). Thus, the bent parts of the wires W are accommodated in the bend accommodating portion when the wire pressing portion 20 is bent towards the mating member (towards the front of the plane of FIG. 1 and in a downward clockwise direction in FIG. 2) by resiliently deforming the resilient portion 31.

The wire pressing portion 20 includes a substantially rectangular base plate 21 with a rear edge coupled to the wire constraining portion 32. Four side walls project down at the front and rear ends of the opposite side edges of the base plate 21. The two side walls at the rear define guiding projections 22 and the two side walls at the front define resilient engaging pieces 23.

The guiding projections 22 project down from the opposite sides of the rear end of the base plate 21 substantially facing each other. A projecting height of the guiding projections 22 is substantially equal to or slightly larger than the cross-sectional dimension of the bundle of the wires W. The lower surface of the base plate 21 in FIG. 2 assumes an alignment along the vertical direction VD when the wire pressing portion is rotated about the resilient portion 31 and relative to the connector-side fixing portion 10 so that the base plate 21 contacts the wires W due to resilient forces of the wires W when the wires W are bent. Thus, the bent parts of the wires W are guided reliably to extend along the vertical direction VD and adjacent the base plate 21 by arranging the wires W adjacent to and between the guiding projections 22.

The resilient engaging pieces 23 include opposed facing deformation restricted portions 23A that extend down from the opposite sides of the rear end of the base plate 21. Deformation permitted portions 23B project down from the outer side surfaces of the bottom ends of the deformation restricted portions 23A while being supported only one end. Each deformation permitted portion 23B is substantially U-shaped and is defined by two supporting arms 23B1 and a bridge 23B2 that unitarily joins the leading ends of the supporting arms 23B1. The supporting arms 23B1 project in a manner to hold the engaging projection 42 therebetween. The upper surface of the bridge 23B2 is set lower than the bottom surfaces of the deformation restricted portions 23A. Thus, an engaging hole 25 is formed by the opposite inner surfaces of the both supporting arms 23B1, the upper surface of the bridge 23B2 and the lower surface of the deformation restricted portion 23A. The engaging hole 25 engages the engaging projection 42 and enables the wire pressing portion 20 to be fixed to the mating member 40.

The lower surface of the base plate 21 receives upward acting resilient repulsive forces from the bent wires W when the wire pressing portion 20 is fixed to the mating member 40, and the lower surfaces of the engaging projections 42 and the upper surfaces of the bridges 23B2 are held in contact with each other. In this state, clearances S are formed between the lower surfaces of the deformation restricted portions 23A and the upper surfaces of the engaging walls 41. The clearances S (FIG. 6) are provided because the upper surfaces of the bridges 23B2 pivotally displace about the base ends thereof and the bridges 23B2 pass positions above those before the displacements upon moving over the engaging projections 42. Accordingly, the clearances S have a length to enable the bridges 23B2 to move over the engaging projections 42 with the lower surfaces of the deformation restricted portions 23A and the upper surfaces of the engaging walls 41 held in contact.

Two opposed auxiliary walls 24 are formed on the inner sides of the resilient engaging pieces 23 and project down from the base plate 21. Each auxiliary wall 24 is in the form of a column having a U-shaped cross section defined by a facing wall 24A and two restricting walls 24B. The facing wall 24A is arranged to face the resilient engaging piece 23. The restricting walls 24B extend out in the width direction WD from the front and rear edges of the facing wall 24A and restrict deformation of the facing wall 24A. The bottom ends of the auxiliary walls 24 are at height positions substantially aligned with the bottom ends of the deformation permitted portions 23B. The outer widthwise edges of the restricting walls 24B are connected unitarily with the deformation restricted portions 23A. Thus, the restricting walls 24B can restrict deformation of the deformation restricted portions 23A while permitting only resilient deformations of the deformation permitted portions 23B in the width direction WD. Further, resilient forces of the deformation permitted portions 23B become larger than in the case where the deformation restricted portions 23A and the auxiliary walls 24 are formed separately. Therefore the engaging holes 25 and engaging projections 42 can be engaged with enhanced forces. It should be noted that a distance between the inner surfaces of the deformation permitted portions 23B and the lateral ends of the restricting walls 24B is substantially equal to or slightly larger than the thickness of the engaging walls 41.

A bulge 27 projects out in the width direction WD from the outer side surface of the bridge 23B2 of each deformation permitted portion 23B. A catching hole 26 penetrates the bulge 27 vertically in the projecting direction of the deformation permitted portion 23B. The catching hole 26 is at a position that can be seen from the base end of the resilient engaging piece 23 and is dimensioned so that a minus driver 50 is insertable therein from the base end of the resilient engaging piece 23. Accordingly, the deformation permitted portion 23B can be displaced out in the width direction WD by inserting the substantially flat minus driver 50 from the base end of the resilient engaging piece 23 and bringing it into catching engagement with the catching hole 26. The catching hole 26 is at the position that can be seen from the base end of the resilient engaging piece 23 because it is difficult to insert the leading end of the minus driver 50 into the catching hole 26 even if the minus driver 50 is inserted from the base end of the resilient engaging piece 23 if the catching hole 26 could not be seen from the base end of the resilient engaging piece 23.

The wire pressing portion 20 is pushed towards the engaging projections 42 to achieve attachment to achieve attachment to the mating member 40. As a result, the resilient portion 31 is deformed and the wires W are bent. Accordingly, the wires W contact the lower surface of the base plate 21 by resilient repulsive forces of the wires W. The engaging walls 41 enter between the deformation permitted portions 23B and the auxiliary walls 24 as the wires W move between the guiding projections 22 and the wire pressing portion 20 is pressed further. The leading ends of the deformation permitted portions 23B then move onto the engaging projections 42 to resiliently deform the deformation permitted portions 23B out in the width direction WD. The deformation permitted portions 23B resiliently restore when the leading ends of the deformation permitted portions 23B move over the engaging projections 42. Thus, the deformation permitted portions 23B and the engaging holes 25 engage the engaging projections 42 to fix the wire pressing portion 20 to the mating member 40.

To detach the wire pressing portion 20 from the mating member 40, the leading end of the minus driver 50 is inserted into a catching hole 25 from the base end of the resilient engaging piece 23. The leading end of the minus driver 50 then is displaced out in the width direction WD to disengage the engaging hole 25 and engaging projection 42. The leading end of the minus driver 50 then is inserted into the other catching hole 25 from the base end of the resilient engaging piece 23 and is displaced out in the width direction WD to disengage the engaging hole 25 and engaging projection 42. Thus, the wire pressing portion 20 can be detached from the mating member 40.

The disengagement jig or minus driver 50 is inserted from the base end of the resilient engaging piece 23 to bring the leading end thereof into catching engagement with the catching hole 26. In this way, the resilient engaging piece 23 is displaced in a disengaging direction to disengage the catching hole 25 and engaging projection 42. Accordingly, the resilient engaging piece 23 can be detached from the mating member 40 by inserting the minus driver 50 from the base end of the resilient engaging piece 23.

The engaging walls 41 are sandwiched between the resilient engaging pieces 23 and auxiliary walls 24 to keep the engaging holes 25 and engaging projections 42 engaged. The resilient engaging pieces 23 are more difficult to deform than if the resilient engaging pieces 23 were provided separately from the auxiliary walls 24. Thus, the engaging holes 25 and engaging projections 42 are not disengaged easily even if the resilient engaging pieces 23 are urged outward.

The resilient engaging pieces 23 are thickened at the sides opposite the engaging walls 41 to increase the depth of the engaging holes 25. Accordingly, engaging forces are improved without reducing the resilient forces of the resilient engaging pieces 23.

Figure 8:
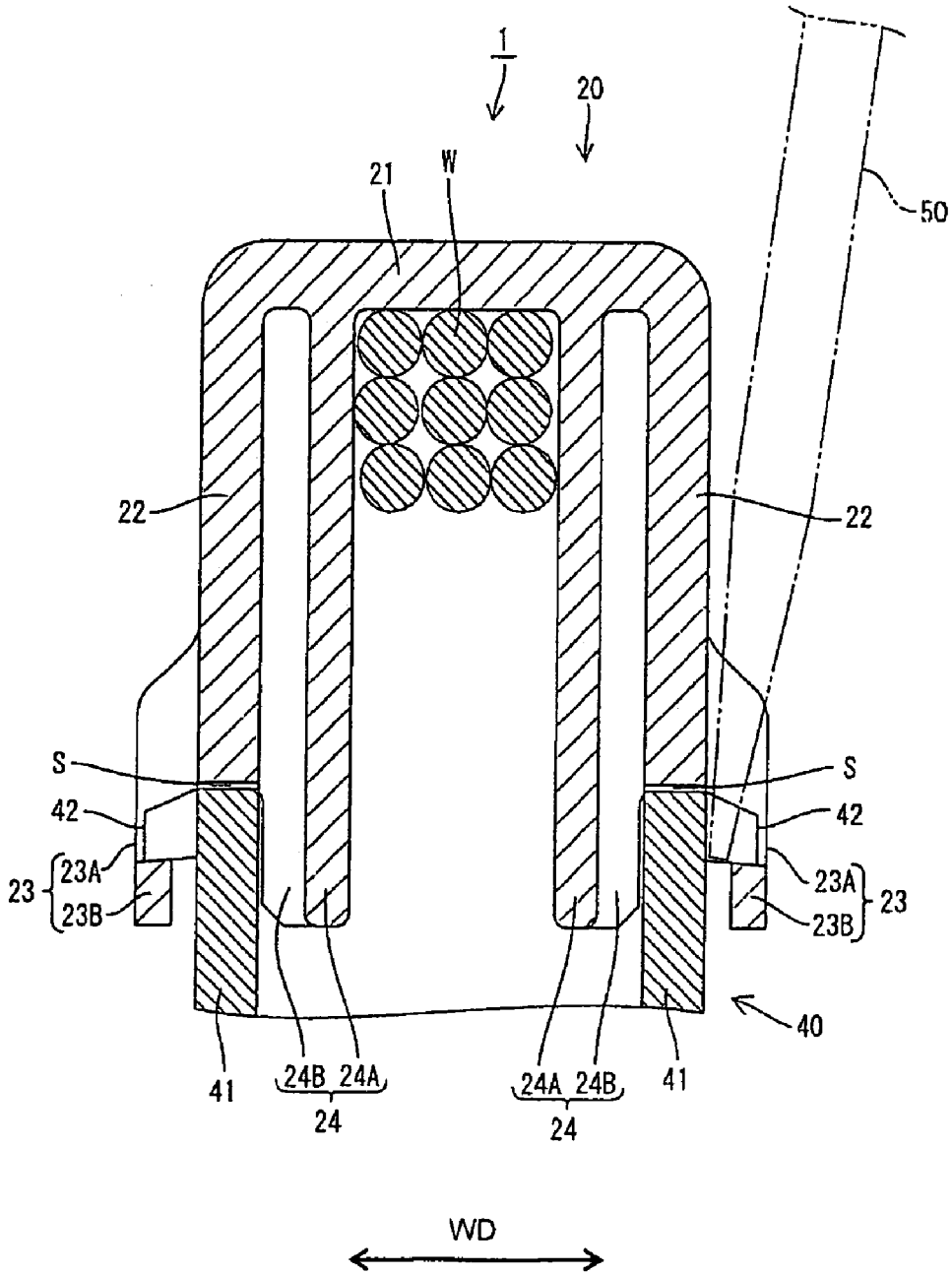
FIG. 8 is a section showing engaged parts of engaging portions and engaging projections.
Figure 9:
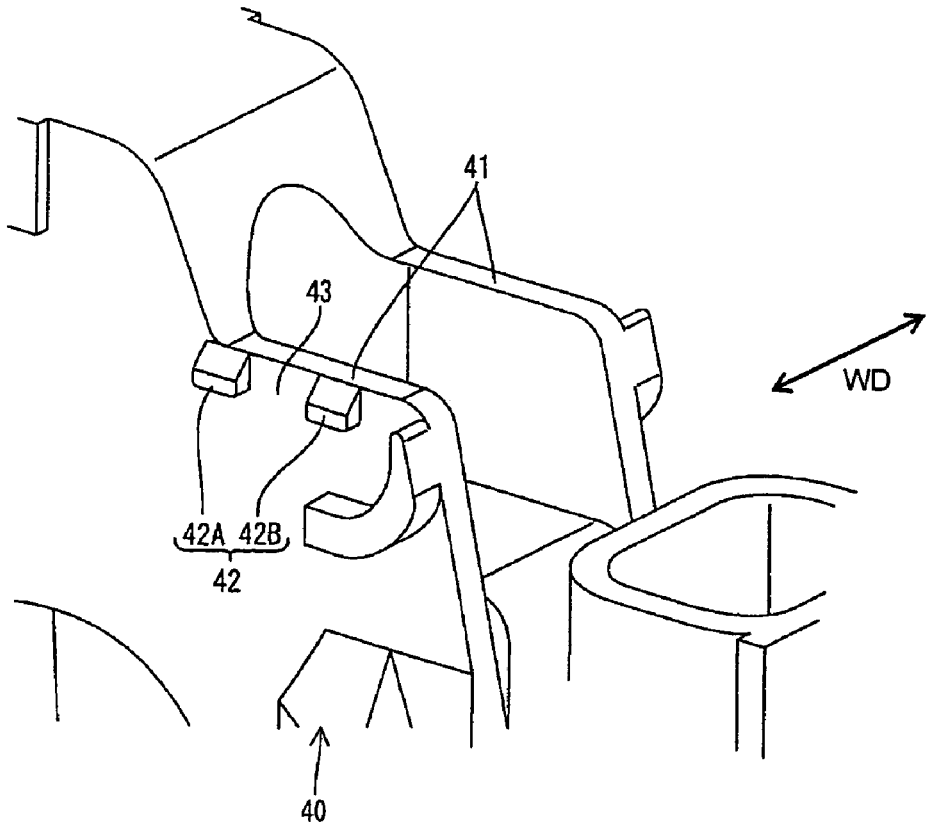
FIG. 9 is a perspective view of a mating member.

A second embodiment of the invention is described with reference to FIGS. 7 to 9. A wire cover 1 of the second embodiment has a wire pressing portion 20 to be held in contact with bent parts of wires or cables W drawn out from a connector (not shown), and the wire pressing portion 20 is to be fixed to a mating member 40 to which the connector is attached. As shown in FIG. 8, the mating member 40 has two engaging walls 41 facing each other, and two engaging projections 42 project from surfaces of end portions of the both engaging walls 41 opposite to the facing surfaces of the engaging walls 41. Each engaging projection 42 has two projections spaced apart by a specified distance. In the following description, the transverse direction in FIG. 8 is referred to as the width direction WD.

Figure 7:
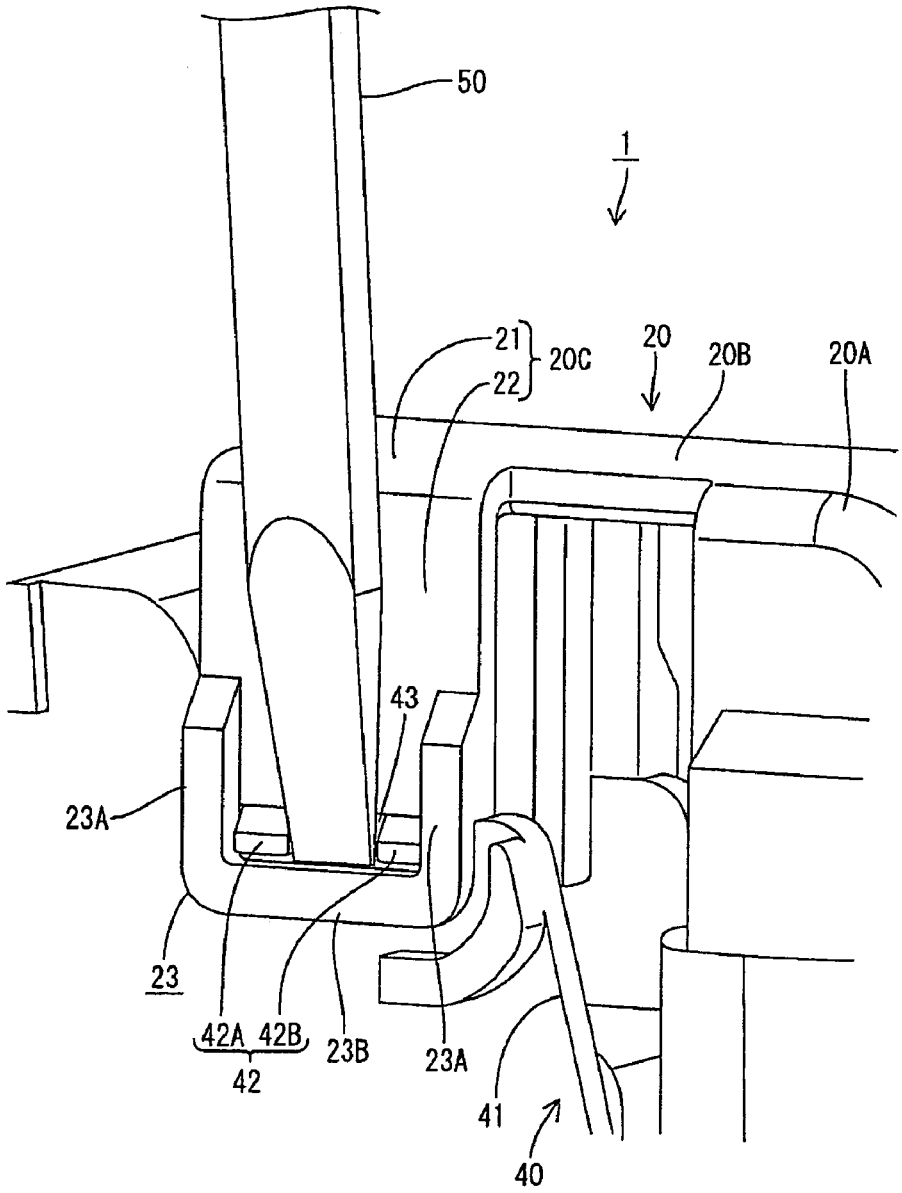
FIG. 7 is a perspective view showing a procedure of a disengaging operation of inserting a minus driver into a disengagement recess in one further embodiment.

As shown in FIG. 7, the wire pressing portion 20 includes a bend accommodating portion 20A for accommodating the bent parts of the wires W, a wire constraining portion 20B to be tied with the wires W by a binding band, binder, clip or the like (not shown), and a lock 20C coupled to the bend accommodating portion 20A via the wire constraining portion 20B and to be fixed to the mating member 40. The lock 20C is comprised of a substantially rectangular base plate 21 connected with the wire constraining portion 20B and two side plates 22 projecting down from the opposite side edges of the base plate 21 to define a substantially U-shaped cross section. Resilient engaging pieces 23 are formed on the outer side surfaces of the side plates 22 and project down from the bottom ends of the side plates 22 to face one another while being supported only at one side.

Each resilient engaging piece 23 is substantially U-shaped and is formed by two supporting arms 23A and an engaging portion 23B that unitarily couples the leading ends of the supporting arms 23A. The supporting arms 23A are spaced apart sufficiently to hold the engaging projection therebetween. The engaging portion 23B is at a position that can be seen from the base end of the resilient engaging piece 23, and a disengagement jig (such as a minus or flat driver 50) can be inserted in a posture substantially parallel to a projecting direction of the resilient engaging piece 23.

The upper surface of the engaging portion 23B is lower than the bottom surfaces of the side plates 22. Thus, an engaging hole 25 is formed by the opposite inner surfaces of the supporting arms 23A, the upper surface of the engaging portion 23B and the lower surface of the side plate 22. The engaging hole 25 is engageable with the engaging projection 42 and the upper surface of the engaging portion 23B can engage the lower surface of the engaging projection 42 to fix the wire pressing portion 20 to the mating member 40. The engaging portion 23B is formed thinner than the supporting arms 23B by having the inner side thereof thinned. Accordingly, the inner surface of the engaging portion 23B is spaced from the outer surface of the engaging wall portion 41.

When the wire pressing portion 20 is mounted to the mating member 40, the lower surface of the base plate 21 receives upward acting resilient repulsive forces from the bent wires W. Thus, the lower surfaces of the engaging projections 42 and the upper surfaces of the engaging portions 23B are urged towards each other and are held in contact with each other. In this state, clearances S are formed between the lower surfaces of the side plates 22 and the upper surfaces of the engaging walls 41. The clearances S are provided because the upper surfaces of the engaging portions 23B make pivotal displacements about the base ends thereof and the engaging portions 23B pass positions above those before the displacements upon moving over the engaging projections 42. Accordingly, the clearances S are set to have a length to enable the engaging portions 23B to move over the engaging projections 42 with the lower surfaces of the side plates 22 and the upper surfaces of the engaging wall portions 41 held in contact.

Two opposed facing auxiliary walls 24 project down from the base plate 21 at the inner sides of the both resilient engaging pieces 23. Each auxiliary wall 24 defines a column having a U-shaped cross section and is comprised of a facing wall 24A arranged to face the side plate 22 and restricting walls 24B extending out in the width direction WD from the front and rear edges of the facing wall 24A. The restricting walls 24B restrict resilient deformation of the facing wall 24A. The bottom ends of the auxiliary walls 24 are at heights substantially aligned with the bottom ends of the resilient engaging pieces 23. The outer widthwise edges of the restricting walls 24B are connected unitarily with the side plate 22. Thus, the restricting walls 24B restrict resilient deformations of the side plates 22 while permitting only resilient deformations of the resilient engaging pieces 23 in the width direction WD. As a result, engaging forces of the engaging holes 25 and engaging projections 42 can be enhanced more as compared to the case where the side plates 22 are formed separately from the auxiliary walls 24. It should be noted that a distance between the inner surfaces of the supporting arms 23A and the lateral ends of the restricting walls 24B is equal to or slightly larger than the thickness of the engaging walls 41.

As described above, each engaging projection 42 is comprised of a front projection 42A and a rear projection 42B at a specified distance from each other. A disengagement recess 43 is defined between the projections 42A, 42B, and the engaging portion 23B is at a position that can be seen from the base end of the resilient engaging piece 23 through this disengagement recess 43. The spacing between the projections 42A, 42B is set to receive the leading end of the minus driver 50. Further, the spacing between the inner surface of the engaging portion 23B and the outer surface of the engaging wall 41 is set to receive the leading end of the minus driver 50. Thus, the resilient engaging piece 23 can be displaced outward in the width direction WD to disengage the engaging hole 25 and engaging projection 42 by inserting the minus driver 50 from the base end of the resilient engaging piece 23 so that the leading end of the minus driver 50 enters the clearance between the inner surface of the engaging portion 23B and the outer surface of the engaging wall 41 through the disengagement recess 43.

If the disengaging recess 43 was at a position that could not be seen from the base end of the resilient engaging piece 23, the minus driver 50 could not be inserted into the disengagement recess 43. In such a case, it may be thought, for example, to insert the minus driver 50 along the outer surface of one supporting arm 23A (surface substantially opposite to the one facing the other supporting arm 23A) from the base end of the resilient engaging piece 23 and to insert the leading end of the minus driver 50 into the clearance between the one supporting arm 23A and engaging wall 41 to displace the engaging portion 23B in a disengaging direction. However, a very large force is necessary to deform the one supporting arms 23A, thereby deteriorating operability. For this reason, the disengagement recess 43 is located at the position that can be seen from the base end of the resilient engaging piece 23.

The wire pressing portion 20 is pushed towards the engaging projections 42 for attaching the wire pressing portion 20 to the mating member 40. Thus, the wires W are bent and the bent parts of the wires W are accommodated into the bend accommodating portion 20A. The wires W contact the lower surface of the base plate 21 by resilient repulsive forces of the wires W. The wire pressing portion 20 is pressed further. As a result, the engaging walls 41 enter between the resilient engaging pieces 23 and auxiliary walls 24, and the engaging portions 23B move onto and over the engaging projections 42 to deform the resilient engaging pieces 23 out in the width direction WD. The resilient engaging pieces 23 resiliently restore when the engaging portions 23B move over the engaging projections 42, and the engaging portions 23B engage the engaging projections 42 to fix the wire pressing portion 20 to the mating member 40.

To detach the wire pressing portion 20 from the mating member 40, the leading end of the minus driver 50 is inserted through the disengagement recess 43 from the base end of one resilient engaging piece 23 to enter the clearance between the engaging portion 23B and engaging wall 41. The leading end of the minus driver 50 then is displaced out in the width direction WD to disengage the engaging portion 23B and engaging projection 42. Subsequently, the leading end of the minus driver 50 is inserted through the disengagement recess 43 from the base end of the other resilient engaging piece 23 to enter the clearance between the engaging portion 23B and engaging wall 41, thereby displacing the resilient engaging piece 23 outward in the width direction WD to disengage the engaging portion 23B and engaging projection 42. In this way, the wire pressing portion 20 can be detached from the mating member 40.

The minus driver 50 can be inserted from the base end of the resilient engaging piece 23 to insert the leading end thereof into the clearance between the engaging portion 23B and mating member 40 through the disengagement recess 43. In this way, the engaging portion 23B can be displaced in a disengaging direction to be disengaged from the mating member 40. Accordingly, the resilient engaging piece 23 can be detached from the mating member 40 by inserting the minus driver 50 from the base end of the resilient engaging piece 23.

The disengagement recesses 43 can be seen from the base ends of the resilient engaging pieces 23 when the resilient engaging pieces 23 are attached to the mating member 40. Further, the disengagement jig 50 can be inserted parallel to the projecting direction of the resilient engaging pieces 23. Accordingly, disengagement is performed more easily than if the through holes were at leading ends of the resilient engaging pieces 23 and leading ends of surrounding walls of the through holes are the engaging portions.

The engaging walls 41 can be sandwiched between the resilient engaging pieces 23 and auxiliary walls 24. Accordingly, the engaging portions 23B and engaging projections 42 can be held engaged. Even if the resilient engaging pieces 23 should try to be resiliently deformed outward, there is no likelihood that the engaging portions 23B and engaging projections 42 are easily disengaged since the resilient engaging pieces 23 become more difficult to deform than in the case where the resilient engaging pieces 23 are provided separately from the auxiliary walls 24.

The invention is not limited to the above described and illustrated embodiment. For example, the following embodiments are also embraced by the technical scope of the present invention as defined by the claims.

Although the auxiliary walls 24 are provided in the foregoing embodiments, they may not be provided according to the invention.

Two resilient engaging pieces 23 and two auxiliary walls 24 are provided in the foregoing embodiment. However, the resilient engaging piece 23 and auxiliary wall 24 may be provided at one of the opposite side edges of the base plate 21 according to the invention.

The resilient engaging pieces 23 and auxiliary walls 24 are formed integrally or unitarily in the foregoing embodiment. However, the resilient engaging pieces 23 may be formed separately form the auxiliary walls 24.

Although the catching portions are in the form of catching holes 26 in the foregoing embodiment, they need not necessarily be through holes and may be formed as recesses with which the disengagement jig can be brought into catching engagement according to the present invention.

The engaging portions are engaging holes 25 and the engageable portions are engaging projections 42 in the first embodiment. However, the engaging portions may be engaging projections and the engageable portions may be engaging holes according to the invention.

Each engaging projection has two spaced apart projections 42A 42B in the foregoing embodiment. However, the base ends of the both projections 42A, 42B may connected with each other according to the invention.

Although the resilient engaging pieces 23 are U-shaped with open base ends in the foregoing embodiment, they may have a hollow rectangular shape by closing the base ends thereof according to the invention.

What is claimed is:

1. A wire cover for bending at least one wire drawn out from a connector in a direction different from a draw-out direction, comprising:

a connector-side fixing portion to be fixed to the connector;

a wire pressing portion to be held in contact with the wire;

a connecting portion connecting the connector-side fixing portion and wire pressing portion;

at least one resilient engaging piece projecting from the wire pressing portion and formed with at least one engaging portion that is engageable to at least one engageable portion of a mating member to fix the wire pressing portion to the mating member; and at least one catch configured for engagement by a jig inserted from an end of the resilient engaging piece substantially adjacent the wire pressing portion for displacing the resilient engaging piece in a direction to disengage the engaging portion and engageable portion.

2. The wire cover of claim 1, wherein the mating member has two opposed facing engaging walls each of the engaging walls having one of the engageable portions, and the wire pressing portion has two of said of resilient engaging pieces provided to be fittable to the corresponding engaging walls from outer sides.

3. The wire cover of claim 1, wherein each resilient engaging piece is formed integrally or unitarily with an auxiliary wall insertable at an inner side of the corresponding engaging wall to sandwich the engaging wall between the resilient engaging piece and the auxiliary wall.

4. The wire cover of claim 3, wherein the engaging portions of the resilient engaging pieces are engaging holes and the engageable portions of the engaging walls are engaging projections.

5. A locking construction for a wire cover including a wire pressing portion to be brought into contact with at least one bent part of at least one wire, comprising:

at least one engaging projection projecting from a mating member;

at least one resilient engaging piece having a base end at the wire pressing portion and projecting from the wire pressing portion substantially towards the engaging projection;

at least one engaging portion provided on the resilient engaging piece and adapted to engage the engaging projection for fixing the resilient engaging piece to the mating member; and at least one disengagement recess formed in the engaging projection for receiving the leading end of a disengagement jig inserted from the base end of the resilient engaging piece, and causing the jig to displace the engaging portion out of engagement with the engaging projection.

6. The locking construction of claim 5, wherein two of the resilient engaging pieces project to hold the engaging projection therebetween.

7. The locking construction of claim 6, wherein each engaging portion is substantially U-shaped and is defined by integrally or unitarily connecting at least leading ends of the resilient engaging pieces.

8. The locking construction of claim 7, wherein the mating member has two opposed engaging walls each having the engaging projection, and two resilient engaging pieces are provided to be fittable to the corresponding engaging walls from outer sides.

9. The locking construction of claim 8, wherein each resilient engaging piece is formed integrally or unitarily with at least one auxiliary wall insertable at an inner side of the corresponding engaging wall to sandwich the engaging wall portion between the resilient engaging piece and the auxiliary wall.

10. A locking construction for a wire cover, comprising:

a wire pressing portion having a base plate with opposite first and second side edges;

first and second deformation restricted portions projecting respectively from the first and second side edges of the base plate of the wire pressing portion and opposed to one another;

first and second U-shaped engaging portions projecting from ends of the respective first and second deformation restricted portions remote from the base plate, each of said U-shaped engaging portions have two substantially parallel arms extending from the end of the deformation restricted portions and a bridge connecting ends of the arms spaced from the deformation restricted portions;

first and second auxiliary walls projecting from the deformation restricted portions and spaced inwardly from the engaging portions; and first and second U-shaped bulges bulging out from the bridge of the engaging portion to define a catching hole therebetween.

11. The locking construction of claim 10, wherein the auxiliary walls are substantially U-shaped columns.

12. The locking construction of claim 10, wherein the auxiliary walls are spaced inwardly from the engaging portions.

13. The locking construction of claim 12, wherein the bulges are spaced farther from the base plate than a projecting distance of the deformation restricted portions from the base plate.

14. The locking construction of claim 12, wherein the bulges extend substantially perpendicularly from the arms of the respective engaging portions.

* * * * *

UNITED STATES PATENT AND TRADEMARK OFFICE

CERTIFICATE OF CORRECTION

PATENT NO. : 7,458,841 B2
APPLICATION NO. : 11/900565
DATED : December 2, 2008
INVENTOR(S) : Tomohiko Kobayashi et al.

It is certified that error appears in the above-identified patent and that said Letters Patent is hereby corrected as shown below:

Title page, item (75) should read as follows:

Tomohiko Kobayashi, Yokkaichi-City (JP);
Tomoyuki Funayama, Toyota-shi (JP);
Tomoo Kakegawa, Toyota-shi (JP);
Shigeki Nishiyama, Toyota-shi (JP);
Hiroshi Kobayashi, Okazaki-shi (JP)

Signed and Sealed this

Third Day of February, 2009

John Doll

JOHN DOLL
*Acting Director of the United States Patent and Trademark Office*